US006806846B1

(12) United States Patent
West

(10) Patent No.: US 6,806,846 B1
(45) Date of Patent: Oct. 19, 2004

(54) FREQUENCY AGILE MATERIAL-BASED REFLECTARRAY ANTENNA

(75) Inventor: James B. West, Cedar Rapids, IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 10/354,280

(22) Filed: Jan. 30, 2003

(51) Int. Cl.[7] ..... H01Q 15/02

(52) U.S. Cl. ..... 343/909; 343/700 MS; 343/754

(58) Field of Search ..... 343/909, 754, 343/700 MS, 756, 853, 778, 850

(56) References Cited

U.S. PATENT DOCUMENTS

| | | | | |
|---|---|---|---|---|
| 4,150,382 A | * | 4/1979 | King | 343/754 |
| 4,198,640 A | | 4/1980 | Bowman | 343/754 |
| 4,323,901 A | | 4/1982 | De Wames et al. | 343/754 |
| 5,481,223 A | | 1/1996 | Wong | 330/124 R |
| 5,694,134 A | * | 12/1997 | Barnes | 343/700 MS |
| 5,835,062 A | | 11/1998 | Heckaman et al. | 343/700 MS |
| 6,285,337 B1 | | 9/2001 | West et al. | 343/853 |
| 6,384,787 B1 | | 5/2002 | Kim et al. | 343/700 MS |
| 6,429,823 B1 | | 8/2002 | Bains et al. | 343/755 |
| 6,441,787 B1 | | 8/2002 | Richards et al. | 343/700 MS |
| 6,483,480 B1 | | 11/2002 | Sievenpiper et al. | |
| 6,552,696 B1 | * | 4/2003 | Sievenpiper et al. | 343/909 |
| 6,650,291 B1 | * | 11/2003 | West et al. | 342/371 |

OTHER PUBLICATIONS

"The Reflectarray Antenna", by D.G. Berry et al., IEEE Transactions on Antennas and Propagation, Nov., 1963, pp. 645–651.

"High–Impedance Electromagnetic Surfaces with a Forbidden Frequency Band", by Dan Sievenpiper et al., IEEE Transactions on Microwave Theory and Techniques, vol. 47, No. 11, Nov. 1999.

"Characteristics of Ka Band Waveguide Using Electromagnetic Crystal Sidewalls", by J. A. Higgins et al., 2002 IEEE MTT–S International Microwave Symposium, Seattle, WA, Jun. 2002.

* cited by examiner

*Primary Examiner*—Wilson Lee
*Assistant Examiner*—Chuc Tran
(74) *Attorney, Agent, or Firm*—Nathan O. Jensen; Kyle Eppele

(57) ABSTRACT

A reflectarray antenna with a scanned radiated beam has an antenna feed for radiating a wave. A reflecting surface excited by the wave is reflected from a reflecting surface located on a tunable substrate in accordance with a variable surface impedance of the tunable substrate modulated to scan the radiated beam. The tunable substrate surface impedance is varied by modulating the dielectric constant or the permeability. The tunable substrate may be an electromagnetic band gap (EBG) material electromagnetic crystal (EXMT) structure to vary the surface impedance. The reflecting surface may be located on short-circuited waveguides with a variable surface impedance modulated to scan the radiated beam by adjusting phase shifts of the waveguides with tunable substrate phase shifter located in the waveguides or by adjusting the position of a piezoelectric movable short.

17 Claims, 6 Drawing Sheets

FREQUENCY AGILE MATERIAL-BASED REFLECTARRAY ANTENNA

BACKGROUND OF THE INVENTION

This invention relates to antennas, reflectarray antennas, and specifically to an electronically scanned reflectarray antenna.

A reflectarray antenna is described in a paper by D. G. Berry et al., "The Reflectarray Antenna", IEEE Transactions on Antennas and Propagation, November, 1963, pp. 645–651. In a basic reflectarray 100 shown in FIG. 1, the amplitude and phase of electromagnetic fields reflected from a surface 105 at any point are determined by the surface impedance at that point. A scanned radiation pattern can be generated by variation of the surface impedance along the two-dimensional (x, y) reflecting planar surface 105. The reflecting surface 105 is spatially excited by a wave 125 from a feed horn antenna 120 or other suitable radiating element, as shown in FIG. 1. The radiated beam 110 from the reflecting surface 105 is a collimated plane wave that may be one of the following forms: a pencil beam parallel to a bore site axis of the array 100, a broad beam or fan beam in one or two dimensions parallel to the bore site axis of the array 100, or a pencil beam pointing at any angle $\theta$ and $\phi$ from the surface 105 less than end-fire relative to the axis normal to the reflecting surface 105.

The tailoring of the surface impedance to obtain a desired radiation pattern may be accomplished in one of two ways. The first method is a continuous surface impedance variation obtained by varying the thickness, d, of a grounded dielectric slab 115 in FIG. 1. The second method is an approximation of a non-uniform surface impedance reflecting surface 105 utilizing radiating elements terminated in shorted transmission lines of various lengths distributed across an array. The second method may be accomplished by dipole radiating elements terminated in shorted transmission lines or open ended waveguides 320 terminated in short circuits as shown for an array 300 in FIG. 6. Other radiating elements, such as microstrip patches, are also possible. In both of these methods the surface impedance is variable along the reflecting surface 105 but is fixed at any one point.

The basic reflectarray architecture has been improved within the existing art to obtain electronic beam scanning by incorporating traditional phase shifter technology, such as PIN diode phase shifters. PIN diode phase shifters have been used in a shorted-circuit microstrip transmission line terminating the radiating elements. The referenced paper discloses a waveguide reflectarray that has switching diodes placed at appropriate intervals from a waveguide aperture to change the distance to a short circuit termination to rapidly electronically scan the antenna. The PIN diode and varactor based reflection phase shifter prior art has several disadvantages. High quantization side lobe levels are present due to a finite bit count of digital phase shifters. Large component counts for electrically large phased arrays are necessary. A 4-bit switched line phased shifter requires 16 diodes per phase shifter. Complex electrical interconnect, both in terms of RF lines, DC bias, and digital control lines are required. Complicated assembly techniques are required with the high component count and complex electrical interconnect. The PIN diode and varactor based phase shifters have maximum RF power limitations.

Waveguide and horn reflectarrays have been implemented using mechanically movable waveguide shorts as disclosed in U.S. Pat. No. 6,429,823. Large arrays at high frequencies make this approach difficult to implement due to the small size of components and the mechanical complexity of the large array due to the number of waveguide elements and the use of motors to move the shorts. An additional disadvantage of motorized moveable waveguide shorts is the slow movement of the shorts and the resulting slow scanning of the antenna beam.

What is needed is a reflectarray antenna that has the capability to scan a radiated beam with more efficient and cost effective phase shift functions.

SUMMARY OF THE INVENTION

A reflectarray antenna having a scanned radiated beam is disclosed. The reflectarray antenna comprises an antenna feed for radiating a wave. A reflecting surface located on a tunable substrate is excited by the wave from the antenna feed. The reflecting surface reflects the wave in accordance with a variable surface impedance of the tunable substrate modulated to scan the radiated beam.

The tunable substrate may be a dielectric slab of ferroelectric material having a dielectric constant modulated by varying a DC electric field to scan the radiated beam. The reflecting surface may comprises traces in selective locations on the reflecting surface to provide the DC electric field to vary the surface impedance to scan the radiated beam. The tunable substrate may be a dielectric slab of ferromagnetic material having a permeability modulated by varying a DC magnetic field to scan the radiated beam.

The tunable substrate may be an electromagnetic band gap (EBG) material electromagnetic crystal (EXMT) structure to vary the surface impedance of the reflecting surface to scan the radiated beam. The EMXT structure is a dielectric substrate of ferroelectric EBG material having a dielectric constant modulated by varying a DC electric field to scan the radiated beam. The EMXT structure may also be a dielectric substrate of ferromagnetic EBG material having a permeability modulated by varying a DC magnetic field to scan the radiated beam. The EMXT structure may also be a dielectric substrate of semiconductor EBG material and a plurality of diodes on the dielectric substrate reverse biased to act as variable capacitors to modulate the surface impedance of the reflecting surface to scan the radiated beam. The EMXT structure may be fabricated on a semiconductor wafer.

The reflectarray antenna may also comprise an antenna feed and a reflecting surface located on a plurality of short-circuited waveguides for reflecting the wave from the antenna feed in accordance with a variable surface impedance modulated to scan the radiated beam by adjusting phase shifts of the waveguides with substrate-based phase shifter located in the waveguides.

Each of the short-circuited waveguides may comprise a bulk dielectric ferroelectric-based phase shifter located on an end cap of the waveguide. A bias electrode connected to a bias feed applies a bias to vary the phase shift by varying the dielectric constant of the bulk dielectric ferroelectric phase shifter. Impedance transformers are used for matching the ferroelectric phase shifter portion of the waveguide to an air filled portion of the waveguide.

Each of the short-circuited waveguides may comprise a tunable electromagnetic band gap material EMXT structure for phase shifting located on two walls of the waveguide. The tunable electromagnetic band gap material varies the phase through an adjustable DC bias on the electromagnetic band gap material. A short circuit at the end of the waveguide for reflects the wave. The EMXT structure may be a dielectric substrate of ferroelectric EBG material having a dielectric constant modulated by varying a DC electric field to scan the radiated beam. The EMXT structure may be a dielectric substrate of ferromagnetic EBG material having a permeability modulated by varying a DC magnetic field to scan the radiated beam. The EMXT structure may be a dielectric substrate of semiconductor EBG material and a plurality of diodes on the dielectric substrate reverse biased to act as variable capacitors to modulate the surface impedance of the reflecting surface to scan the radiated beam.

The reflectarray antenna short-circuited waveguides may be a tunable electromagnetic band gap material EMXT structure for phase shifting located at an end of the waveguide to create a reactive impedance termination for reflecting the wave.

The reflectarray antenna with a scanned radiated beam may comprise an antenna feed for radiating a wave and a reflecting surface located on a plurality of short-circuited waveguides for reflecting the wave from the antenna feed in accordance with a variable surface impedance modulated to scan the radiated beam by adjusting phase shifts of the waveguides. Each of the short-circuited waveguides comprises a metallized piezoelectric shorting surface located in the waveguide to vary the length of the waveguide when a bias is applied.

It is an object of the present invention to provide a reflectarray antenna that has the capability to scan a radiated beam in two dimensions using efficient and cost effective phase shift functions.

It is an object of the present invention to realize an electronically scanned reflectarray antenna that incorporates tunable substrate electromagnetic band gap materials.

It is an object of the present invention to realize an electronically scanned reflectarray antenna that incorporates shorted waveguides with phase shifters and waveguides with moveable shorts.

It is an advantage of the present invention to reduce the complexity of phase shift control circuits.

It is an advantage of the present invention to provide a continuously variable phase shift across a reflecting surface in a reflectarray antenna.

It is a feature of the present invention to reduce feed complexity by replacing a constrained feed with a spatial feed.

It is a feature of the present invention to provide conformal reflecting surfaces.

It is a feature of the present invention to provide twice the phase shift with a shorted waveguide approach.

BRIEF DESCRIPTION OF THE DRAWINGS

The invention may be more fully understood by reading the following description of the preferred embodiments of the invention in conjunction with the appended drawings wherein.

DETAILED DESCRIPTION

The present invention is for a reflectarray antenna that uses tunable substrate materials as variable phase shifters and shorted waveguides with phase shifters to scan a beam when the reflectarray antenna is used as a phased array resulting in a more efficient and cost effective antenna.

Two basic approaches may be used to implement variable phase shift in the reflectarray to scan a beam in the present invention. The first approach to vary a surface impedance of a substrate is to vary the phase shift by using a tunable dielectric substrate or a tunable electromagnetic band gap (EBG) substrate reflecting surface. In the second approach shorted transmission line sections or waveguides are used for feeding the radiating elements. Phase shift is obtained in the shorted waveguide by variable phase shifters using tunable dielectric substrates or EBG substrates or by electronic adjustment of the length of the shorted transmission line sections by means of piezoelectric technology.

Figure 1:
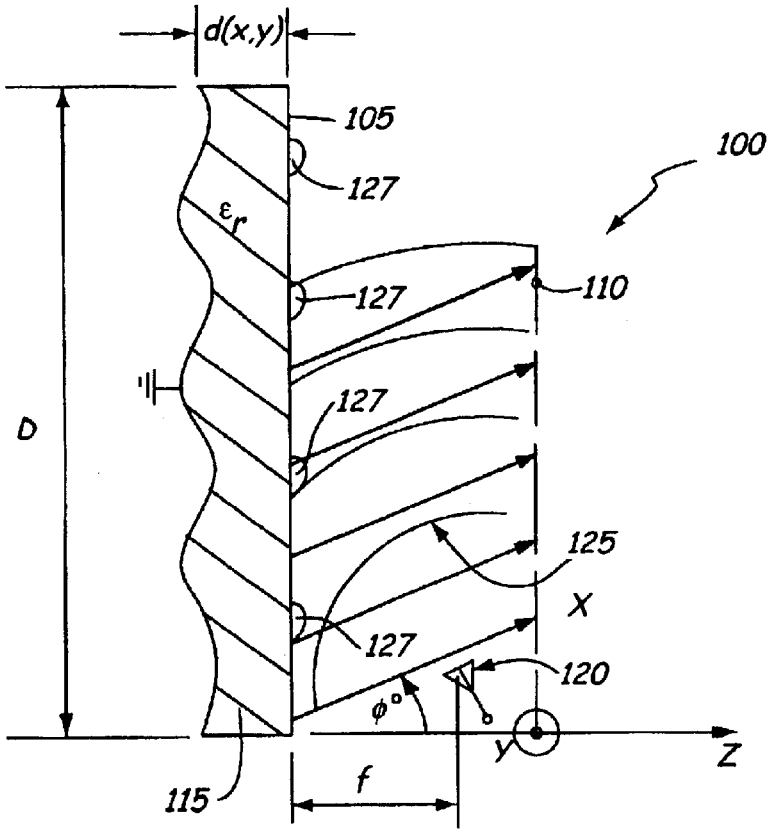
FIG. 1 is a diagram of a monolithic substrate reflectarray antenna whose beam may be scanned by varying surface impedance.

In the tunable dielectric substrate reflecting surface embodiment of the first approach the surface impedance of the dielectric slab 115 of FIG. 1 is electronically modulated by adjusting the material properties of dielectric constant, $\in r$, of ferroelectric materials or permeability, $\mu r$, of ferromagnetic materials. The term ferroelectric is used in the general sense throughout this description. The term ferroelectric is used for material operation within either ferroelectric or paraelectric phases. Ferroelectric materials include bulk crystal, ceramic and thin film materials common in the art. Ferromagnetic materials include ceramic and thin film materials.

The referenced paper details the relationship between the reflected wave 110 pointing angle and the surface impedance of the two-dimensional array reflecting surface 105. The surface impedance distribution, $X_S$, needed to obtain a desired phase shift of the reflected wave 110 to form and electronically scan the radiation pattern of the reflected wave 110 is shown in Equation 1.

$$X_S = \eta_o\left(\frac{1}{\sqrt{\varepsilon_r}}\tan\left(\sqrt{\varepsilon_r}\,k_o d\right)\right) \qquad \text{Equation 1}$$

where:

$k_o = 2\pi/\lambda_o$ = the wave number in free space d = the dielectric thickness $\in_r$=the relative dielectric constant of the material, and $\eta_o$=free space wave impedance.

In the reference paper, non-uniform fixed surface impedances are obtained by differences in thickness d of the grounded dielectric slab 115 in two dimensions. The surface impedances are not dynamically variable to scan the radiated beam. In one embodiment of the present invention, an improved methodology is implemented to modulate the surface impendence of the dielectric slab 115 by electrically adjusting dielectric constant, $\in_r$, or permeability, $\mu_r$, material parameters. In the present invention, the substrate 115 material may be either of uniform thickness, d, or also different over certain regions if required to obtain desired surface impedances.

The dielectric constant, $\in_r$, for a grounded ferroelectric slab 115 in FIG. 1 is adjusted by varying a DC electric field (voltage) within the ferroelectric substrate. The DC bias is provided to the top surface of the ferroelectric material by thin, selective plating or deposition of indium tin oxide (ITO) traces 127 in FIG. 1. The composition of the deposition is designed to provide DC voltages to the top-side of the ferroelectric material while simultaneously providing a minimal perturbation to the RF energy being reflected off the surface.

The detailed implementation of the deposition scheme for ITO is described U.S. Pat. No. 4,323,901 incorporated by reference in its entirety. In the reference patent, depositions are made on the slab by using microelectronic and thin film technology that offer the advantages of low cost, compact design, light weight, and highly accurate electrode spacing. Current technology is available to deposit submicron thickness indium tin oxide strips on layers of electrically active material with densities of approximately 200 lines per centimeter, so that the electrode spacing and accuracy necessary for millimeter waves can readily be achieved. Such strips cause only a negligible loss to the propagating beam.

Another method is to tune by electrically adjusting the permeability, $\mu_r$, of a grounded ferromagnetic (ferrite) slab 115 by varying a DC magnetic field within the ferrite substrate. Individual sections of ferrite substrate each with an independent DC H-field bias can be assembled in a mosaic panel fashion, discussed below, to implement a surface impedance adjustment. The DC bias can be applied in several ways, including placing individual electromagnets behind each ferrite section. Techniques similar to those used in planar transformer technology for contemporary DC-DC power converter applications known in the art may be used. The surface impedance distribution, $X_S$, needed to obtain a desired phase shift of the reflected wave 110 to form and electronically scan the radiation pattern of the reflected wave 110 for a ferrite substrate is shown in Equation 2.

$$X_S=\eta_o[\sqrt{a}\mu_r/\in_r\tan(\sqrt{\mu_r\in_r}k_o d)] \quad \text{Equation 2}$$

where:

$k_o=2\pi/\lambda_o$=the wave number in free space d =the dielectric thickness $\in_r$=the relative dielectric constant of the material, $\mu_r$=the relative permeability; and $\eta_o$=free space wave impedance.

Ferroelectric and ferromagnetic materials are currently the only materials whose electrical parameters of relative permittivity and/or permeability can be altered or tuned by means of an external stimulus such as a DC bias field. It should be noted, however, that the reflectarray concepts described herein are equally applicable to any new, yet to be discovered materials that exhibit similar electrical material parameter modulation by means of an external stimulus signal.

Substrates with adjustable material parameters, such as ferroelectric or ferromagnetic materials can be fabricated monolithically, i.e. in a continuous planar substrate without segmentation or subassemblies, through thin film deposition, ceramic fabrication techniques, or semiconductor wafer bulk crystal growth techniques. An example of bulk crystal growth the Czochralski crystal pulling technique that is known within the art to grow germanium, silicon and a wide range of compound semiconductors, oxides, metals, and halides.

Figure 2:
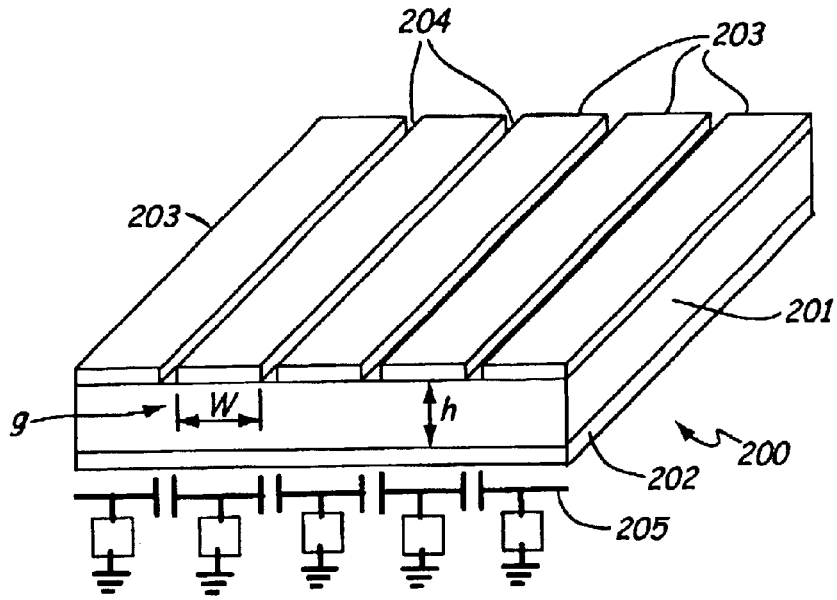
FIG. 2 is a diagram of a stripe electromagnetic crystal structure.

Another embodiment of the first approach is to use electromagnetic band gap (EBG) material in a tunable electromagnetic crystal (EMXT) structure monolithically fabricated on a common wafer or substrate in place of the dielectric slab 115 in FIG. 1. A typical EMXT structure 200, shown in FIG. 2, is described in a paper by J. A. Higgins et al. "Characteristics of Ka Band Waveguide using Electromagnetic Crystal Sidewalls" 2002 IEEE MTT-S International Microwave Symposium, Seattle, Wash., June 2002. Other similar structures may be implemented based on design requirements. Electromagnetic band gap (EBG) materials, known in the art, are periodic dielectric materials that forbid propagation of electromagnetic waves in a certain frequency range. The EBG material may be GaAs, ferroelectric, ferromagnetic, or any suitable EBG embodiment. Other future currently unknown EBG substrate embodiments are also applicable to the present invention.

In the EMXT structure 200 of FIG. 2, a thin dielectric substrate 201 is metallized completely on one side 202 and has stripes 203 of metal or other conducting material separated by narrow gaps 204 on the other side. The substrate 201 may be any low loss material. The gap 204 acts as a capacitance and the substrate 201 thickness h and the stripe 203 width w provide an inductance to ground as shown in an equivalent circuit 205. At certain frequencies, as determined by the substrate tuning, incident waves are reflected from the EMXT device 200.

For ferroelectric and ferromagnetic tunable EBG substrates used in the EMXT structure 200, the grounded dielectric substrate 201 of FIG. 2 is realized by one of many methods, as previously described. Here the dielectric constant and the permeability are again varied with a DC bias applied to the conducting stripes 203 to tune the EMXT device 200. Metal deposition techniques are used to form the required top-side metallic geometries and back side bias control signal line interconnections. The size of the reflecting surface 105, which equates to reflect array antenna gain and beam width for a given frequency, is limited only by the substrate fabrication and metal deposition processes.

Figure 3:
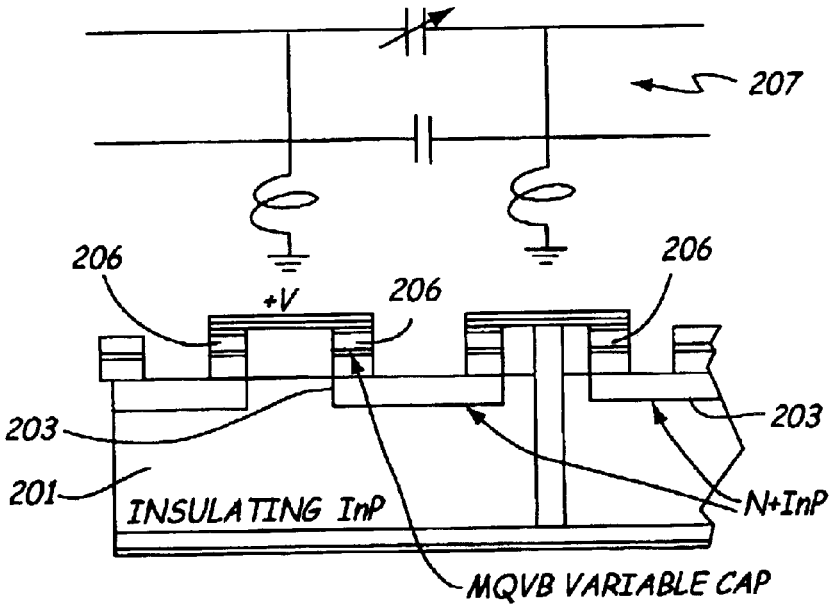
FIG. 3 is a cross section of a tunable electromagnetic crystal structure.

A tunable EBG device EMXT structure 200 may also be implemented in semiconductor MMIC (monolithic microwave integrated circuit) technology as described in the paper. Gallium arsenide (GaAs) and indium phosphide (InP) semiconductor substrates 201 are currently practical, but other III–V compounds are feasible. In these implementations the semiconductor substrate 201 acts as a passive (non-tunable) dielectric material, and tunability is obtained with traditional semiconductor devices, such as varactor or Schotkky diodes 206 in FIG. 3 connected across conducting stripes 203. The diodes 206 within the EMXT structure 200 are reversed biased to provide a variable capacitance as a function of applied voltage. These variable capacitances modulate the surface impedance of the EMXT device 200 to generate phase shift across the wave that reflects off its surface. An equivalent circuit 207 is shown in FIG. 3. The semiconductor device tuning elements, the top side metal geometries and the back side bias control signal line interconnections are all realized by means of commonly know semiconductor fabrication techniques. An entire semiconductor wafer, which is typically sized to eight inches in diameter with the current state of the art, may be implemented as the entire reflectarray reflecting surface 105. Back side fabrication processing provides DC bias for individual EMXT sections for all these cases.

Figure 4:
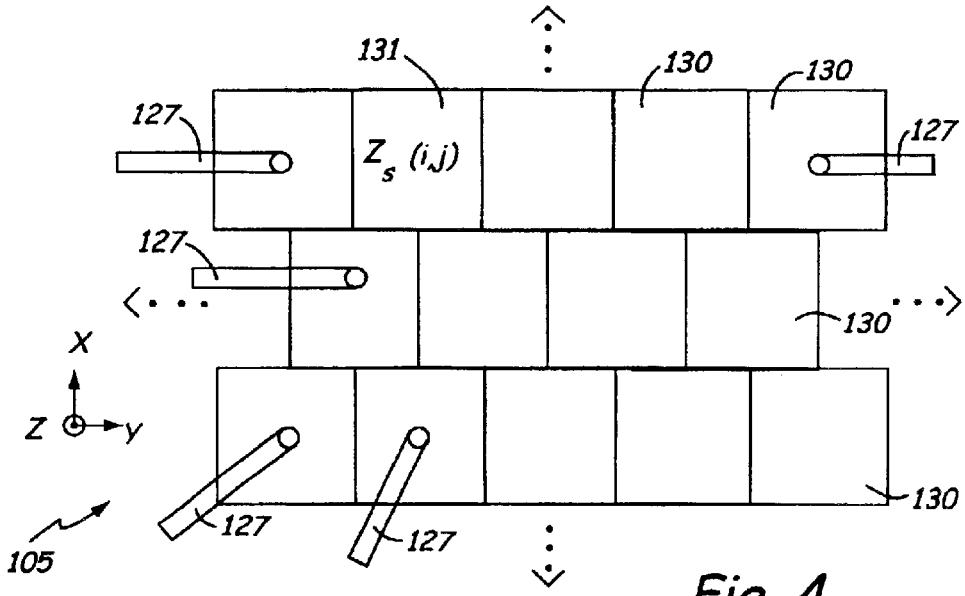
FIG. 4 is a diagram showing a mosaic panel assembly method for a reflectarray antenna.

Both methods for adjusting the surface impedance, $X_S$, of the reflecting surface 105 by using a tunable substrate to varying the dielectric constant or the permeability or by tuning an electromagnetic band gap EMXT structure discussed above may be implemented in a mosaic panel shown in FIG. 4. In FIG. 4, a portion of the reflecting surface 105 is shown made up of individual mosaic panels 130. Each mosaic panel 130 has bias isolation from adjacent mosaic panels 130. The surface impedance of mosaic panel (i, j) 131 is $Z_s$(i, j). ITO circuit traces 127 provide the DC bias voltage to vary the dielectric constant in a ferroelectric substrate slab to each mosaic panel. U.S. Pat. No. 6,285,337, incorporated herein by reference in it entirety, provides a description of a mosaic assembly technique. The conducting stripes 203 may be used to supply bias to EMXT structures as previously discussed.

Figure 5:
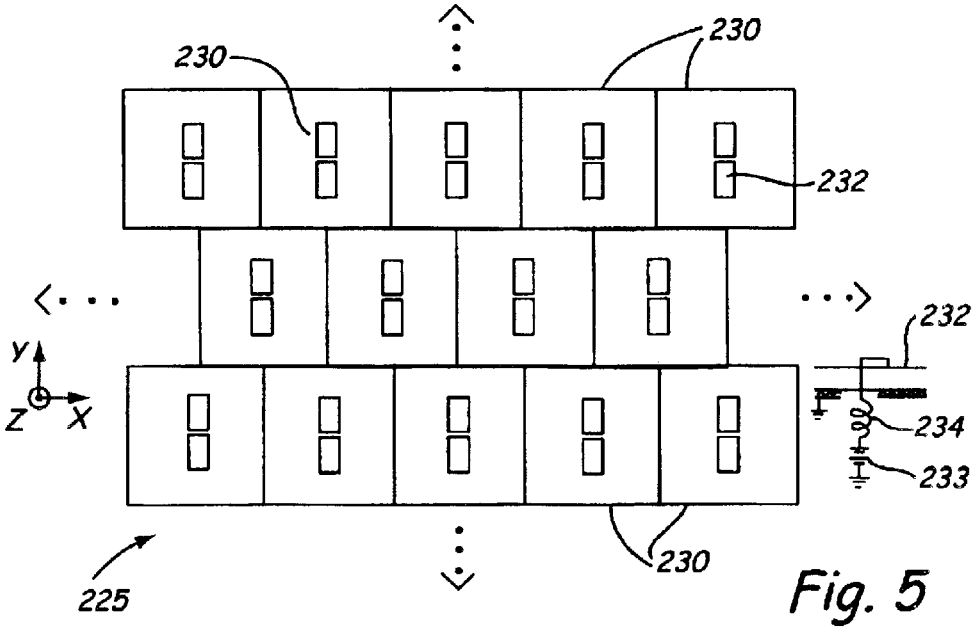
FIG. 5 is a diagram of a mosaic panel assembly with dipole scatterers on a variable dielectric substrate.

Metallic scatterers, such as microstrip patches, strip dipoles, or other planar radiating elements may be used in conjunction with tunable grounded substrates to assist in the adjustment of the surface impedance for beam scanning. This concept can be implemented either as a monolithic structure or a mosaic panel. Strip dipoles, microstrip patches, or other planar radiating elements may be mounted on either ferroelectric or ferromagnetic substrates. FIG. 5 is an example of an array 225 of dipole mosaic panels 230 that can be individually biased by utilizing the mosaic assembly approach as previous described in conjunction with FIG. 4. A dipole 232 metallization can provide an electrode to bias the substrate with a DC electric field for the ferroelectric implementation. A bias supply 233 provides the bias through a radio frequency choke (RFC) 234 to the dipole 232. Each mosaic panel 230 has bias isolation from adjacent panels 230. The dipole 232 in each mosaic panel 230 acts as a radiating element to assist in varying the surface impedance.

A continuous variable surface impedance along the reflecting surface 105 may be created with a mosaic panel of tunable electromagnetic band gap EMXT structures 200. As one example of the concept, separate tunable EBG structures 200 can be assembled in the mosaic pattern of FIG. 4 to provide bias isolation between the reflectarray sub-panels. A large mosaic panel array to form a reflectarray antenna may also be constructed from several semiconductor wafers containing EMXT devices.

Figure 6:
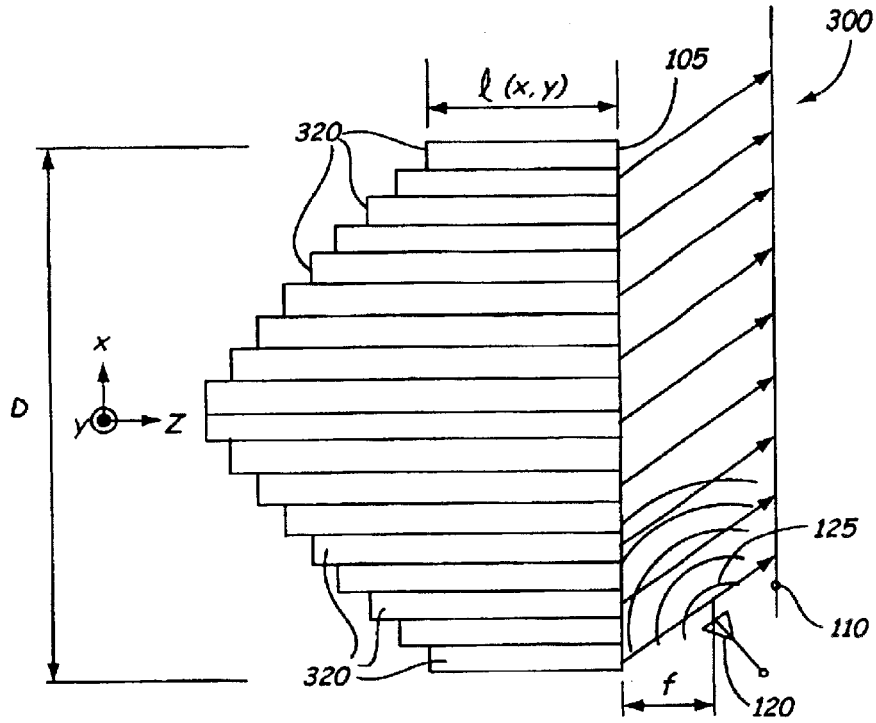
FIG. 6 is a diagram of a short-circuited transmission line implementation of a reflectarray antenna.

The first implementation of the second basic approach to provide variable phase shift in a reflectarray is to incorporate ferroelectric tunable substrate or tunable electromagnetic band gap (EBG) substrate phase shifters similar to those already described into short-circuited transmission lines or waveguides that feed the radiating elements of the reflectarray. A basic reflectarray 300 architecture employing an array of short-circuited waveguides 320 is shown schematically in FIG. 6. Here again the reflecting surface 105 is spatially excited by the wave 125 from the feed horn 120 or other suitable radiating element resulting in the radiated wave 110, as shown in FIG. 1.

The input impedance, $X_{in}$, of a short-circuited section of $TE_{10}$ rectangular waveguide 320 is determined by Equation 3.

$$X_{in} = \eta \cdot \frac{2 \cdot \frac{b}{a}}{\sqrt{1 - \left(\frac{\lambda}{\lambda_{co}}\right)^2}} \tan\left(2 \cdot \pi \cdot \frac{d}{\lambda_g}\right) \qquad \text{Equation 3}$$

where:

$\lambda$=the space wave length $\lambda_{co}$=the waveguide cut off frequency $\lambda_g$=the guide wavelength, b =the narrow waveguide wall dimension a =the broad wall waveguide dimension, d =the short circuited waveguide length, and $\eta$=free space intrinsic impedance.

The input surface impedance of a rectangular aperture is a function of the length, l, of the shorted waveguide section 320. Other short circuit sections of transmission lines of different topologies can be used, and each has similar impedance expressions as is known in the art. It is possible to implement a phased array 300 by embedding phase shifters into the short-circuited transmission lines or waveguides 320.

Figure 7:
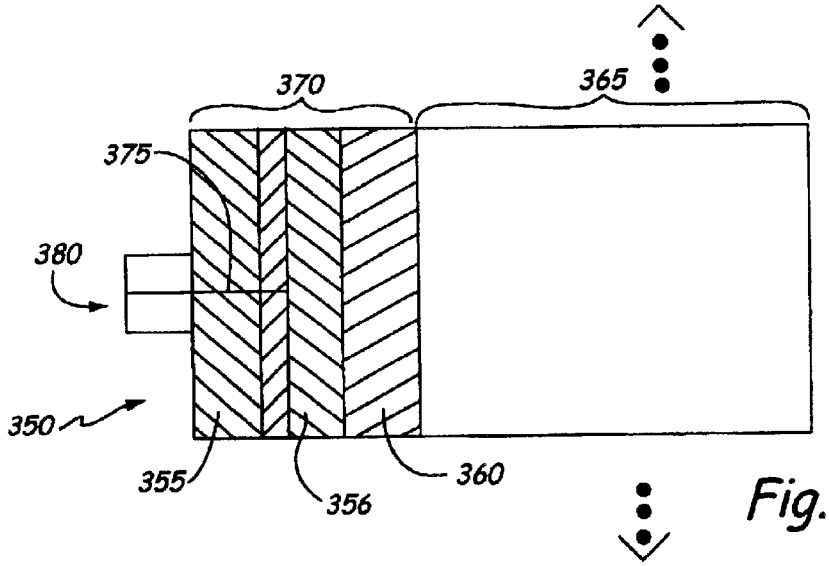
FIG. 7 is a diagram of a ferroelectric phase shifter located in one of the short- circuited waveguides of the reflectarray antenna of FIG. 6.

One short-circuited waveguide embodiment 350 of the present invention, shown in FIG. 7, is to use a bulk dielectric ferroelectric-based phase shifter 355 with matching sections 356 and 360 on the waveguide end cap. Here an air filled waveguide section, 365 feeding a radiation aperture is terminated in a short-circuited section of ferroelectric loaded waveguide 370. Phase shift is obtained by varying the dielectric constant of the ferroelectric 355 with a DC bias applied to a bias electrode 375 through a bias feed 380. Matching section 356 can either be a passive dielectric material or a second tunable ferroelectric section. Waveguide matching section impedance transformers 356 and 360 are used to match the ferroelectric filled waveguide 370 with the air filled waveguide 365. One or more matching sections may be used.

Figure 8:
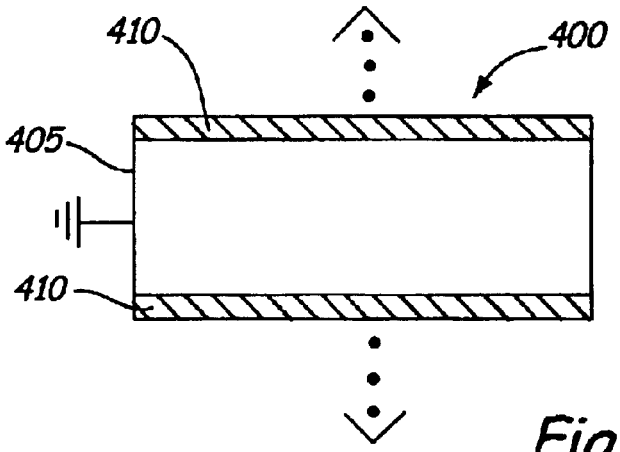
FIG. 8 is a diagram of a short-circuited waveguide of FIG. 6 having tunable electromagnetic band gap material located on the waveguide walls.

An alternative short-circuited waveguide embodiment 400 of this invention, shown in FIG. 8, is to use tunable electromagnetic band gap materials to implement waveguide phase shifters. Tunable electromagnetic band gap material EMXT structures 410 are added to two walls of the waveguide 400 and the end of the waveguide 400 is short-circuited 405 as shown in FIG. 8. Detailed descriptions for TEM waveguide sections with tunable EBG phase shifter technologies are available in the previously mentioned paper by J. A. Higgins et al. Many EMXT embodiments are possible including GaAs semiconductor with reverse biased diodes 206 acting as tuning capacitors as shown in FIG. 3 and ferrite or ferroelectric substrates 210 tunes with a DC bias as shown in FIG. 2.

Figure 9:
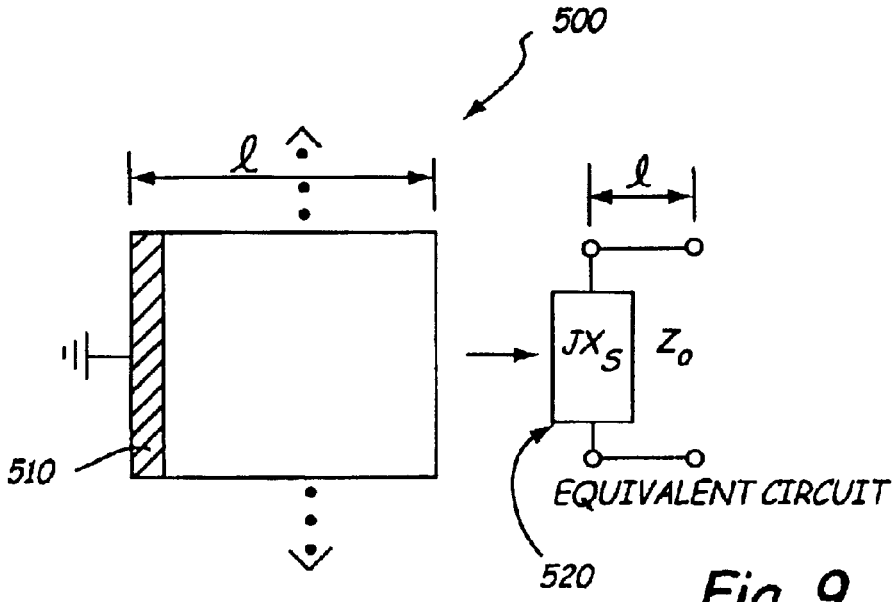
FIG. 9 is a diagram of a short-circuited waveguide of FIG. 6 having tunable ferroelectric, ferromagnetic, or electromagnetic band gap material located at the end of the waveguide to create a variable reactance.

A third embodiment to uses grounded tunable electromagnetic band gap material EMXT substrates as a reactive impedance termination 510 to a waveguide 500, as shown in FIG. 9. A variable reactance 520, shown in the equivalent circuit, is realized when the center frequency of the surface impedance of the EMXT substrate termination 510 is varied. The variable reactance 520 produces a variable phase shift similar to a reflected line phase shifter known in the art. Here again the EMXT structure may be GaAs semiconductor with reverse biased diodes 206 acting as tuning capacitors as shown in FIG. 3 and ferrite or ferroelectric substrates 210 tunes with a DC bias as shown in FIG. 2.

The embodiment shown in FIG. 9 may also be implemented with a tunable grounded dielectric slab as the variable reactance 520 where the surface impedance of the dielectric slab is electronically modulated by adjusting the material properties of dielectric constant, $\in_r$, of ferroelectric materials or permeability, $\mu_r$, of ferromagnetic materials as shown in FIG. 1.

Figure 10:
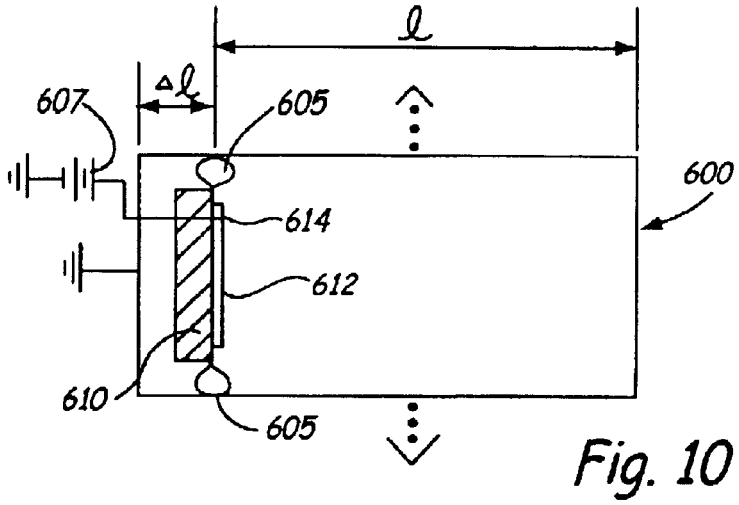
FIG. 10 is a diagram of a short-circuited waveguide of FIG. 6 that has a piezoelectric tunable short circuit.

The second implementation of the second basic approach to the frequency agile reflectarray invention uses piezoelectric technology to implement a variable length short-circuited metallic waveguide transmission line 600 shown in FIG. 10. In FIG. 10 an implementation using springs 605 to contact a metallized piezoelectric crystal shorting surface 610 and interior waveguide walls to create a robust RF current path is illustrated. Metallization 612 on the shorting surface 610 is DC isolated from the springs 605 and from ground. The required deflection for a two way phase shift of 360° is 5 mm at 30 GHz. A bias from source 607 on the piezoelectric crystal shorting surface 610 places a stress on its crystalline structure that in turn causes the length of the crystal to change. A connection 614 may be made to the metallization 612 on the piezoelectric crystal shorting surface 610 to supply the bias. The required piezoelectric crystal 610 displacement reduces as the operating frequency of the reflectarray increases.

Figure 11:
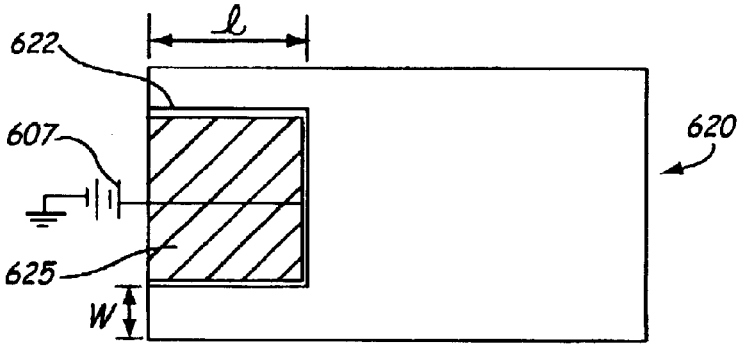
FIG. 11 is a diagram of another embodiment of a variable length short-circuited metallic waveguide using piezoelectric devices.

Another embodiment of a variable length short-circuited metallic waveguide 620 using piezoelectric devices is a choked short shown in FIG. 11. A piece of piezoelectric material 625 with metallization 622 is placed at the end of the short-circuited waveguide 620. The waveguide choke is formed by a region of length l and gap w around the piezoelectric material 625. The length, l, of the piezoelectric material 625 is adjusted with the voltage supply 607 connected to the metallization 622. By adjusting the length by the piezoelectric effect a capacitive and inductive reactance is obtained to vary the phase shift.

The antenna feeds 120 for all the reflect-array embodiments in this invention are similar in design and function as those of the traditional reflectarray described in the reference paper. Prime focus, offset feed, and Cassigrain/Gregorian dual reflector systems or other multiple reflector systems, may be used. Both sum beam and monopulse feed implementations can be incorporated in the basic design.

In addition, a quasi optic semiconductor amplifier grid approach developed by the Rockwell Scientific Company and disclosed in U.S. Pat. No. 5,481,223 incorporated by reference can be used to realize an active feed for both transmit and receive applications. This can be an advantage for the following scenarios: minimize loss to maximize loop gain for a communications or radar system, reduction of reflectarray axial dimension (the axis of the focal distance) for applications with tight space requirements, and minimize feed blockage in a system requiring the receiver front end or transmitter output be attached directly to the feed for loss minimization.

The discussion thus far has focused on a two dimensional implementation of the reflecting surface 105. The concepts discussed herein can be readily extended to three dimensions to implement a singly conformal (e.g. cylindrical) and double conformal reflecting surfaces using the chamfered mosaic panel approach detailed in U.S. Pat. No. 6,285,337.

With the present invention, a constrained feed network is replaced with a spatial feed to reduce complexity. All of the bias and interconnect lines can be conveniently routed to the back of the array.

Figure 12:
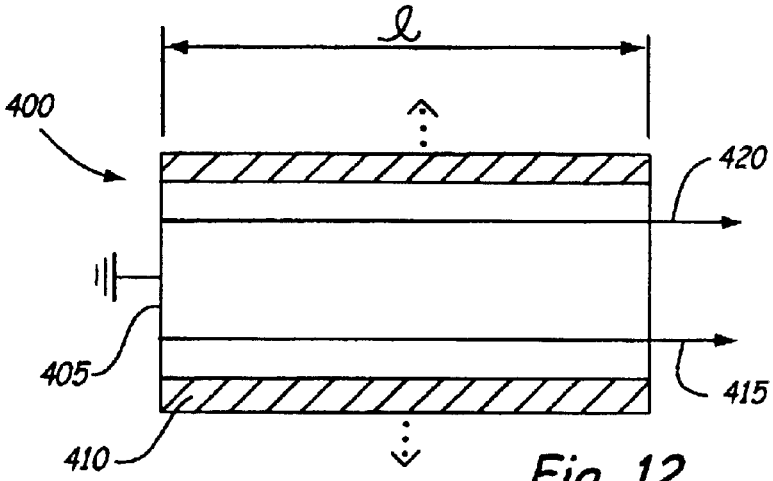
FIG. 12 showing how the phase and a wave is shifted twice when traveling through the waveguide of FIG. 6.

With the shorted waveguide approach, the phase shift function is twice that of a single pass phase shifter due to the two way travel of the wave caused by the reflection off of a shorting surface 405 as shown in FIG. 12. Incident wave 415 experiences a phase shift $Ø_o$, into the waveguide 400 and reflected wave 420 experiences another phase shift $Ø_o$. It is easier to obtain 360° of analog phase shift for a given transmission line length, l, with the two way reflectarray implementation.

With the present invention, the various frequency agile material based surface impedance modulation techniques and EBG based ferroelectric and ferromagnetic phase shifting schemes are analog in nature which precludes undesirable quantization side lobes. The phase shifter topologies described herein are much simpler than traditional phase shifters in terms of RF, DC, and control logic interconnect.

It is believed that the frequency agile material-based reflectarray antenna of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A reflectarray antenna having a scanned radiated beam said reflectarray antenna comprising:

an antenna feed for radiating a wave;

a reflecting surface excited by the wave from the antenna feed; and a tunable substrate having said reflecting surface located thereon for reflecting said wave in accordance with a variable surface impedance of the tunable substrate modulated to scan the radiated beam said tunable substrate comprising one of a dielectric slab of ferroelectric material having a dielectric constant modulated by varying a DC electric field, a dielectric slab of ferromagnetic material having a permeability modulated by varying a DC magnetic field, and an electromagnetic band gap (EBG) material electromagnetic crystal (EMXT) structure to vary the surface impedance of the reflecting surface.

2. The reflectarray antenna of claim 1 wherein the reflecting surface further comprises traces in selective locations on the reflecting surface to provide the DC electric field to vary the surface impedance to scan the radiated beam.

3. The reflectarray antenna of claim 1 wherein the EMXT structure comprises a dielectric substrate of ferroelectric EBG material having a dielectric constant modulated by varying a DC electric field to scan the radiated beam.

4. The reflectarray antenna of claim 1 wherein the EMXT structure comprises a dielectric substrate of ferromagnetic EBG material having a permeability modulated by varying a DC magnetic field to scan the radiated beam.

5. The reflectarray antenna of claim 1 wherein the EMXT structure comprises:

a dielectric substrate of semiconductor EBG material; and a plurality of diodes on the dielectric substrate reverse biased to act as variable capacitors to modulate the surface impedance of the reflecting surface to scan the radiated beam.

6. The reflectarray antenna of claim 5 wherein the EMXT structure is fabricated on a semiconductor wafer.

7. A reflectarray antenna having a scanned radiated beam said reflectarray antenna comprising:

an antenna feed for radiating a wave;

a reflecting surface excited by the wave from the antenna feed; and a plurality of short-circuited waveguides having said reflecting surface located thereon for reflecting the wave from the antenna feed in accordance with a variable surface impedance modulated to scan the radiated beam by adjusting phase shifts of the waveguides; and a plurality of tunable substrate phase shifters located in the plurality of short-circuited waveguides for adjusting phase shifts of the waveguides wherein each of said plurality of tunable substrate phase shifters comprises one of a bulk dielectric ferroelectric-based phase shifter located on an end cap of said waveguide and a tunable electromagnetic band gap (EBG) material electromagnetic crystal (EMXT) structure.

8. The reflectarray antenna of claim 7 wherein each of said plurality of short-circuited waveguides further comprises:

a bias electrode for varying the phase shift by varying the dielectric constant of the bulk dielectric ferroelectric phase shifter;

a bias feed for applying a bias on the bias electrode; and impedance transformers for matching the ferroelectric phase shifter portion of the waveguide to an air filled portion of the waveguide.

9. The reflectarray antenna of claim 7 wherein each of said plurality of short-circuited waveguides further comprises:

the tunable electromagnetic band gap material EMXT structure for phase shifting located on two walls of said waveguide said tunable electromagnetic band gap material EMXT structure varying the phase by adjusting a DC bias on the electromagnetic band gap material EMXT structure; and a short circuit at the end of said waveguide for reflecting the wave.

10. The reflectarray antenna of claim 9 wherein the EMXT structure comprises a dielectric substrate of ferroelectric EBG material having a dielectric constant modulated by varying a DC electric field to scan the radiated beam.

11. The reflectarray antenna of claim 9 wherein the EMXT structure comprises a dielectric substrate of ferromagnetic EBG material having a permeability modulated by varying a DC magnetic field to scan the radiated beam.

12. The reflectarray antenna of claim 9 wherein the EMXT structure comprises:

a dielectric substrate of semiconductor EBG material; and a plurality of diodes on the dielectric substrate reverse biased to act as variable capacitors to modulate the surface impedance of the reflecting surface to scan the radiated beam.

13. The reflectarray antenna of claim 7 wherein each of said short-circuited waveguides further comprises the tunable electromagnetic band gap material EMXT structure located at an end of said waveguide for phase shifting by creating a reactive impedance termination for reflecting the wave.

14. The reflectarray antenna of claim 13 wherein the EMXT structure comprises a dielectric substrate of ferroelectric EBG material having a dielectric constant modulated by varying a DC electric field to scan the radiated beam.

15. The reflectarray antenna of claim 13 wherein the EMXT structure comprises a dielectric substrate of ferromagnetic EBG material having a permeability modulated by varying a DC magnetic field to scan the radiated beam.

16. The reflectarray antenna of claim 13 wherein the EMXT structure comprises:

a dielectric substrate of semiconductor EBG material; and a plurality of diodes on the dielectric substrate reverse biased to act as variable capacitors to modulate the surface impedance of the reflecting surface to scan the radiated beam.

17. A reflectarray antenna having a scanned radiated beam said reflectarray antenna comprising:

an antenna feed for radiating a wave; and a reflecting surface said reflecting surface located on a plurality of short-circuited waveguides for reflecting the wave from the antenna feed in accordance with a variable surface impedance modulated to scan the radiated beam by adjusting phase shifts of the waveguides each of said short-circuited waveguides comprises a metallized piezoelectric shorting surface located in said waveguide to vary the length of the waveguide when a bias is applied.

* * * * *